United States Patent [19]

Sachar et al.

[11] Patent Number: 4,566,636

[45] **Date of Patent: * Jan. 28, 1986**

[54] PRODUCING LIQUID DROPLETS BEARING ELECTRICAL CHARGES

[75] Inventors: Kenneth S. Sachar, Brookline; Stanley R. Rich, Wellesley Hills, both of Mass.

[73] Assignee: Micropure, Incorporated, Natick, Mass.

[ * ] Notice: The portion of the term of this patent subsequent to Oct. 8, 2002 has been disclaimed.

[21] Appl. No.: 707,531

[22] Filed: Mar. 4, 1985

Related U.S. Application Data

[63] Continuation of Ser. No. 512,746, Jul. 11, 1983, abandoned, which is a continuation of Ser. No. 278,660, Jun. 29, 1981, abandoned.

[51] Int. Cl.[4] ..... B05B 5/02

[52] U.S. Cl. ..... 239/698; 239/704

[58] Field of Search ..... 239/3, 690, 697–708

[56] References Cited

U.S. PATENT DOCUMENTS

| | | | |
|---|---|---|---|
| 2,804,341 | 8/1957 | Bete | 239/601 |
| 3,698,635 | 10/1972 | Sickles . | |
| 3,873,024 | 3/1975 | Probst et al. | 239/704 |
| 4,009,829 | 3/1977 | Sickles | 239/705 |
| 4,077,374 | 3/1978 | Willmann | 239/708 X |
| 4,215,818 | 8/1980 | Hopkinson | 239/703 X |
| 4,347,984 | 9/1982 | Sickles | 239/707 |
| 4,362,275 | 12/1982 | Coffee | 239/700 |

FOREIGN PATENT DOCUMENTS

| | | | |
|---|---|---|---|
| 662156 | 5/1979 | U.S.S.R. | 239/703 |

*Primary Examiner*—Andres Kashnikow

*Attorney, Agent, or Firm*—Wolf, Greenfield & Sacks

[57] ABSTRACT

Electrically charging liquid droplets by causing a liquid sheet to expand in area and to break up into droplets in a region adjacent to an electrode.

16 Claims, 2 Drawing Figures

PRODUCING LIQUID DROPLETS BEARING ELECTRICAL CHARGES

This application is a continuation of application Ser. No. 512,746, filed July 11, 1983, now abandoned which in turn is a continuation of application Ser. No. 278,660, filed June 29, 1981, also abandoned.

BACKGROUND OF THE INVENTION (1) Field of the Invention

This invention relates in general to methods and means for producing liquid droplets bearing electrical charges; more particularly, to methods and means for electrical charging of large volumes of liquid, and for producing electrically-charged droplets of liquids flowing at rates in the order of many gallons per minute per spray nozzle, over a wide range of electrical conductivity of liquid.

(2) Description of the Prior Art

The use and application of charged liquid droplets is well known, for example, in electrostatic spray painting, air pollution control, and spraying of pesticides. There could be substantially greater and more widespread use and application of electrically charged liquid droplets but for the fact that all existing droplet charging systems, as known to the applicants, have extremely small liquid flow rates, at most typically less than a few tenths of a gallon per minute per spray nozzle. Thus, up to now, electrostatic induction of charges on a surface of water, for example, has been limited to water flowing at small volume rates because it is necessary to maximize the ratio of liquid surface area to liquid volume. To charge water efficiently, spray nozzles comprising essentially capillary tubing, or orifices less than 20 mils in diameter, are used to eject water streams through or near non-contacting charging electrodes for the purpose of inducing electrical charge on the surfaces of these water streams. Droplets of water are formed in a region of the fine water stream after leaving the nozzle structure, and in the most efficient prior art nozzle designs the charging electrode extends beyond the region in which the charge is formed on the liquid surface, so as to preserve the charge on the droplets. The region of droplet formation can begin either immediately upon leaving the nozzle or at a distance therefrom, depending upon the particular nozzle design. The result is a high level of electrostatic charge per unit volume of the resulting water droplets, but the volume per unit time per nozzle is very small. Any attempt to increase the volume of liquid from, as by increasing the diameter of the water discharge, lowers the ratio of liquid surface area to liquid volume resulting in a uselessly low level of electric charge per unit volume of liquid spray.

To our knowledge, all liquid charging systems up to the present time which are intended to charge large volumes of water, and to produce electrically-charged droplets of liquids flowing at large unit volume rates, have made use of a multiplicity of nozzles having fine, capillary-like spray orifices. These devices plug easily with suspended solids; they are complicated and expensive to fabricate; and they are difficult and expensive to maintain.

SUMMARY OF THE INVENTION

The present invention teaches a new basic principle which permits electrical charging by induction of large volumes of liquid issuing from a single large nozzle through an opening sufficiently large that it is not plugged with solids carried in the liquid, and which can be constructed at low cost. The flowing liquid leaving the nozzle is made to take the form of an area-wise expanding sheet, which becomes thinner as it expands in area. The shape of this expanding sheet of liquid can vary between a hollow cone and a disc and beyond, as desired. The thinning sheet expands into a zone where it fluctuates at random, becomes unstable and breaks into droplets. This zone-of-instability is not sharply defined; it has no fixed edge or boundary. Before breaking into droplets, the sheet of liquid can become as thin as a few mils, having as a result an optimized high ratio of surface area to volume. This sets the stage for efficient induction of electrical charge by charge-inducing means placed nearby but spaced from the expanding sheet. According to the invention, for efficient charge induction the charge-inducing means extends from the region in which the liquid is in the form of a contiguous sheet, over and beyond the zone-of-instability to the region in which the sheet of liquid breaks into droplets. The charge-inducing means can be an electrode which is connected to a source of suitable voltage; alternatively it can be an electret requiring no electric power supply. In either event, the charge-inducing means maintains the electric charge on the surfaces of the droplets without regard to fluctuations in the instantaneous location within the zone-of-instability of the separation of the droplets from the sheet.

We have found that the area-wise expanding sheet has a "boundary" at which droplets are formed which fluctuates at random, as much as plus-and-minus two centimeters, in one case. Observations with a fine wire probe connected to an ohmmeter, confirmed visually with a strobe light, have enabled us to determine instantaneous locations of the "boundary" within the zone-of-instability. In addition, the liquid sheet itself waves like a flag, so that a volume, 3-dimensional instability is observed. We have discovered that positioning the charge-inducing system so that the liquid sheet/droplet breakup zone and the concomitant random fluctuations in both are always "covered" by the charge-inducing system provides substantially the same electric field everywhere that the liquid sheet breaks into droplets, and permits a substantially uniform high level of electric charge to be imparted to the droplets regardless of the random fluctuations of the liquid/droplet boundary. Together with the thinning of the liquid sheet as the flow diverges (expands area-wise), leading to an ever-increasing ratio of surface area per unit volume flow of liquid, we are able with this arrangement to achieve both a high volume of liquid flow and a high electric charge on the drops from a single nozzle.

Our invention is operable with many existing nozzles of various specific designs, if such nozzles are modified to incorporate induction charging systems according to the invention.

DETAILED DESCRIPTION OF THE DRAWINGS

Figure 1:
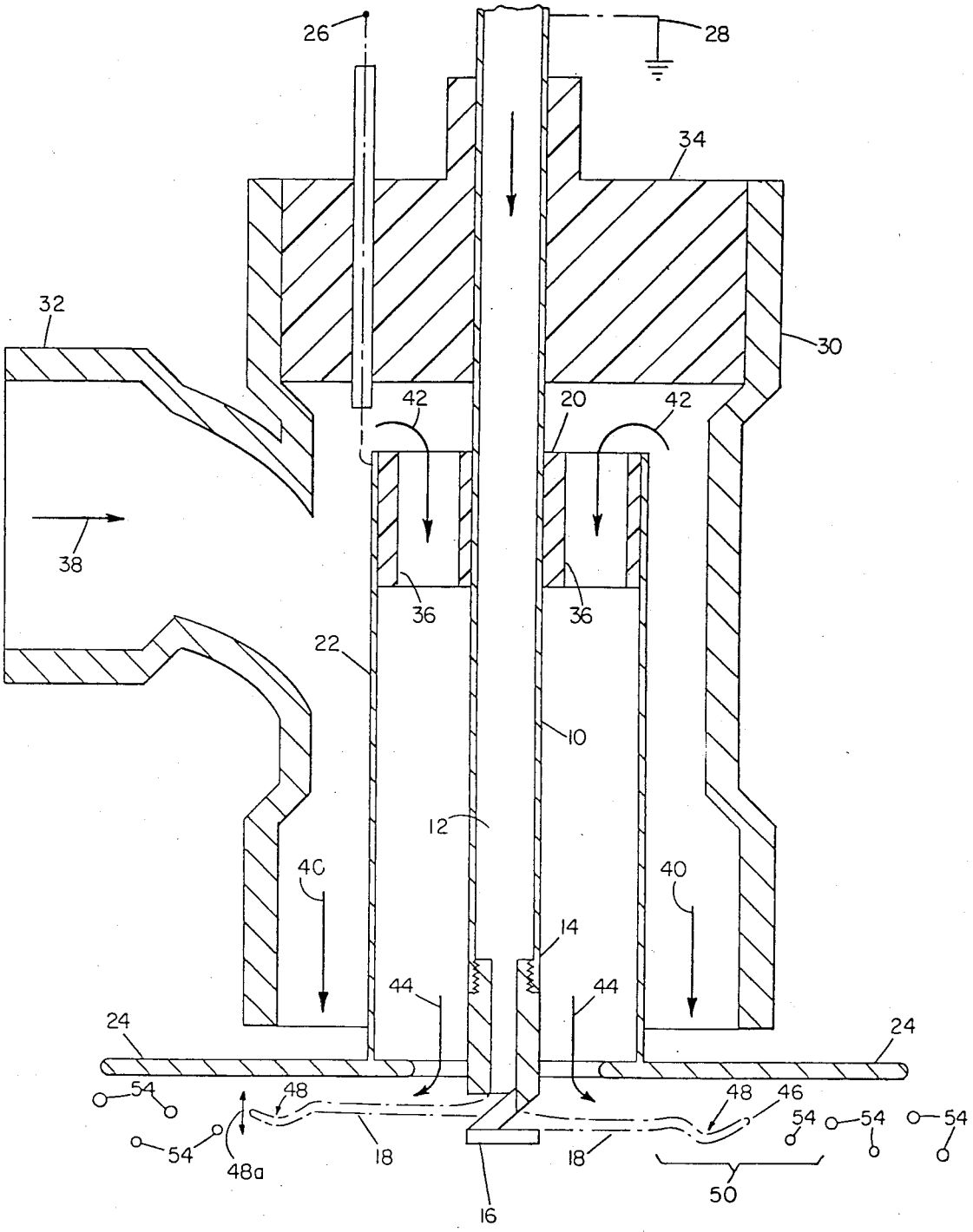
FIG. 1 is a longitudinal-sectional view of a spray nozzle incorporating the invention with a disc-shaped radially-expanding liquid sheet.
Figure 2:
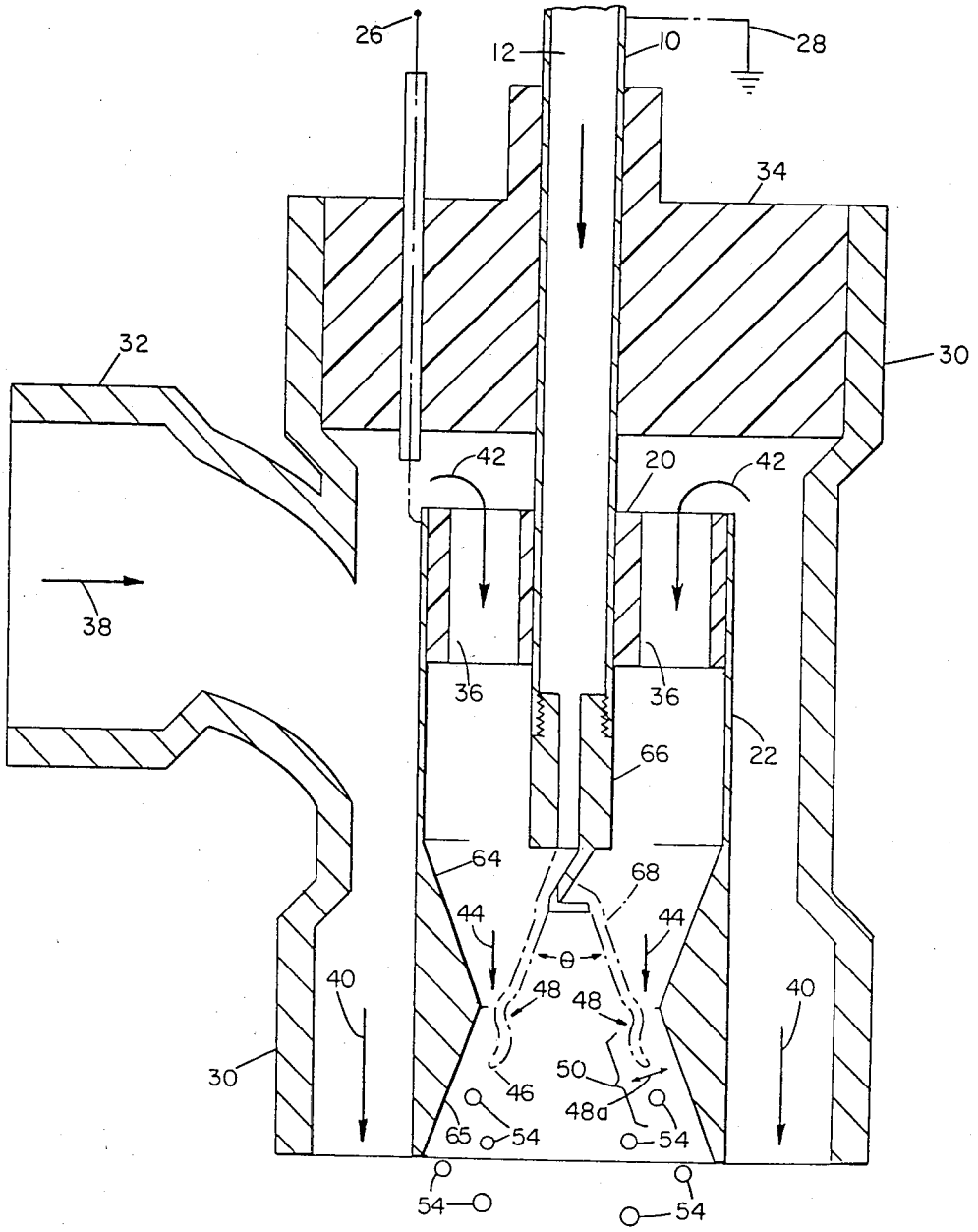
FIG. 2 is a longitudinal-sectional view of a spray nozzle incorporating the invention with a cone-shaped expanding liquid sheet.

FIGS. 1 and 2 are similar in many aspects.

Referring first to FIG. 1, parts common to both illustrated embodiments of the invention include an electrically-conductive flow pipe 10 for carrying flowing liquid 12 to a nozzle end 14 of the flow pipe. Either the flow pipe itself or an electrode in contact with the liquid is necessary to provide an electrical ground. In FIG. 1, this end 14 is fitted with a nozzle 16 which provides a disc-shaped sheet of liquid 18, which expands area-wise radially, thinning in thickness as the radius is enlarged. An electrically-insulating stand-off 20 is fitted to the outside of the pipe 10, and an electrically-conductive electrode support 22 is mounted to the periphery of the stand-off. The electrode support extends to the vicinity of the nozzle 16 where a disc-shaped charging electrode 24 is attached to the support, which holds the charging electrode near but spaced from the expanding liquid sheet 18. The charging electrode 24 is connected via the support 22 to a source 26 of negative potential, here shown at (−) 10 KV. The pipe 10 is connected to ground, at 28. A sheath 30 with air inlet 32 surrounds and is spaced from the electrode support 22, being mounted to a stand-off 34 which is fixed on the flow pipe 10. The electrically-insulating stand-off 20 is perforated with apertures 36 through which air can flow. Air introduced via the air-inlet 32, indicated by an arrow 38 flows along each side of the electrode support 22, passing through the apertures 36 to reach the inside, as is indicated by arrows 40, 42 and 44, serving to preserve electrical isolation of the charging electrode 24. Air from the inner side of the electrode support 22 is exhausted between the charging electrode 24 and the expanding liquid sheet 18.

As the liquid sheet 18 expands in radius, and in area, it becomes both thinner and unstable, waving like a flag toward and away from the charging electrode 24, as is indicated at 48 and arrow 48-A, and eventually breaking into droplets 54. The peripheral edge 46 of the liquid sheet is not fixed, and the radius of the sheet 18 fluctuates at random in magnitude (e.g., +2 cm over a mean radius of 5 cm), at the same time that the sheet is waving back and forth at random transverse to its direction of expansion. The place where these random fluctuations take place is a zone-of-instability, generally indicated as the zone spanned by a bracket 50. In this zone, the liquid sheet 18 randomly breaks into droplets 54. The electrode 24 overlies, or spans, the entire region from the stable, expanding liquid sheet 18 over the zone-of-instability 50, to the region consisting substantially entirely of droplets 54. In this way, the liquid sheet 18 is electrostatically charged by the electrode 24, and the charge is maintained on the droplets 54 as they are formed. The nozzle 16 has a high volume flow rate, and the sheet 18 becomes so thin as the liquid approaches the zone-of-instability that the ratio of surface area to volume grows greatly as the sheet breaks into droplets.

Thus the invention provides enhanced electrostatic charging of liquid droplets while producing those droplets from a liquid flowing at a high volume per unit time.

The nozzle 16 shown in FIG. 1 is a form of spiral-flow nozzle, sometimes known as "Bete Fog Nozzle", which is described in U.S. Pat. No. 2,804,341. This nozzle configuration is presently preferred for use in practicing the invention because it is capable of producing a very thin liquid sheet 18 and a very fine liquid droplets spray 54. A flow rate of 4.5 gallons per minute at 120 p.s.i. is available from a single nozzle, with an orifice of ⅛ inch, which is substantially immune to plugging by liquid-borne solids.

FIG. 2 is similar to FIG. 1, except that the nozzle 66 which is used produces a conical sheet of liquid 68, having a cone angle $\theta$. The charging electrode 64 is shaped to conform to the conical sheet. Otherwise, like parts of both figures bear the same reference characters. The cone angle $\theta$ can vary between values as small as about 10 degrees to the value of 180 degrees that is shown in FIG. 1, and up to 350°.

The invention can be practiced with any liquid-spray nozzle that can be combined with a charging electrode system according to the invention; that is, an electrode system which spans the region from stable area-wise expanding liquid sheet over the zone-of-instability, to the region where liquid droplets are established. The electrode system can take any desired form; an electret system which does not require the presence of a source 26 of high voltage can be used if desired.

RELATED INVENTIONS

An invention generic to the inventions of the present application was the sole conception of Mr. Stanely R. Rich, and is the subject of a sole patent application filed on even date herewith.

What is claimed is:

1. Apparatus for producing liquid droplets bearing electrical charges comprising means to produce an unsupported flowing area-wise expanding sheet of liquid which is bounded by a pair of surfaces and which becomes thinner as it expands in the direction of flow into a randomly-fluctuating zone-of-instability extending a substantial distance in said direction of flow wherein said sheet becomes unstable and breaks into droplets, charge-inducing means nearby and spaced from one surface of said sheet and conforming in shape generally with the flow of said expanding sheet for inducing an electric charge on at least said one surface of said sheet, said charge-inducing means extending continuously over said sheet prior to and including said zone-of-instability including the region in which said droplets are formed and said droplets immediately after they are formed so as to maintain said electric charge on the surfaces of said droplets as they are formed and immediately thereafter without regard to fluctuation in the instantaneous location within said zone-of-instability of the separation of said droplets from said sheet.

2. Apparatus according to claim 1 wherein said sheet lies on the locus of the surface of a tube which expands in diameter from a first region of relatively small diameter to a second region of relatively larger diameter.

3. Apparatus according to claim 2 wherein said tube is a cone having a cone angle $\theta$ of between approximately 10 degrees and a limit of 350 degrees.

4. Apparatus according to claim 1 wherein said sheet is disc-shaped.

5. Apparatus according to claim 1 including a nozzle for producing said area-wise expanding sheet of liquid, and means to feed a liquid to said nozzle.

6. Apparatus according to claim 5 wherein said nozzle produces a cone-shaped sheet of liquid, and said charge-inducing means has a cone-shaped surface extending over said randomly fluctuating zone from the nearby continuous part of said sheet to beyond said zone-of-instability over the region in which said droplets are formed, said cone-shaped surface having a cone angle which approximates the cone angle of said sheet of liquid.

7. Apparatus according to claim 5 wherein said nozzle produces a disc-shaped sheet of liquid, and said charge-inducing means has a substantially flat-annular part extending over said randomly-fluctuating zone from the nearby continuous part of said sheet to beyond said zone-of-instability over the region in which said droplets are formed.

8. Apparatus according to claim 1 including a nozzle for producing said area-wise expanding sheet of liquid, electrode means for inducing said electric charge, and means to maintain said electrode means in a fixed spatial relation to said nozzle.

9. Apparatus according to claim 8 including conduit means to feed liquid to said nozzle, tubular means surrounding said conduit means at least in part, said tubular means supporting said electrode means in said fixed spatial relation.

10. Apparatus according to claim 9, including means to provide a stream of gas moving between said tubular means and said conduit means toward said nozzle, and from there between said electrode means and said sheet of liquid toward said zone-of-instability.

11. Apparatus according to claim 8 including means to supply a voltage difference between said electrode means and said sheet of liquid.

12. Apparatus according to claim 1 including means to provide a stream of gas moving between said charge-inducing means and said sheet of liquid from said sheet upstream of said zone-of-instability toward said zone-of-instability.

13. Apparatus according to claim 12 wherein said charge-inducing means includes an electret.

14. Apparatus according to claim 12 including a source of voltage and means to connect said charge-inducing means to said source.

15. Apparatus according to claim 12 including means to supply a stream of gas moving over the side of said charge-inducing means which is away from said sheet of liquid.

16. Apparatus according to claim 1 including means to supply a stream of gas moving between said charge-inducing means and said zone-of-instability and a second stream of gas moving over the sides of said charge-inducing means which are away from said sheet of liquid for the purpose of keeping the charge-inducing means electrically isolated from its surroundings and for preventing the collection of liquid or solid materials upon the charge-inducing means.

* * * * *